United States Patent [19]

Morimoto et al.

[11] Patent Number: 4,594,316

[45] Date of Patent: Jun. 10, 1986

[54] PHOTOGRAPHIC LIGHT-SENSITIVE MATERIAL WITH REDUCIBLE PHOTOGRAPHICALLY USEFUL MOIETY RELEASER

[75] Inventors: Kiyoshi Morimoto; Keizo Furuya; Masaharu Toriuchi, all of Kanagawa, Japan

[73] Assignee: Fuji Photo Film Co., Ltd., Kanagawa, Japan

[21] Appl. No.: 660,838

[22] Filed: Oct. 15, 1984

[30] Foreign Application Priority Data

Oct. 13, 1983 [JP] Japan ..... 58-191243

[51] Int. Cl.[4] ..... G03C 1/40; G03C 5/54; G03C 1/42; G03C 1/06

[52] U.S. Cl. ..... 430/559; 430/212; 430/218; 430/219; 430/223; 430/564; 430/566; 430/607; 430/611; 430/621

[58] Field of Search ..... 430/223, 242, 559, 212, 430/218, 219, 564, 566, 611, 621, 607

[56] References Cited

U.S. PATENT DOCUMENTS

| | | | |
|---|---|---|---|
| 4,139,379 | 2/1979 | Chasman et al. | 430/223 |
| 4,232,107 | 11/1980 | Janssens | 430/223 |
| 4,371,604 | 2/1983 | Van de Sande et al. | 430/223 |
| 4,477,554 | 10/1984 | Van de Sande et al. | 430/223 |

OTHER PUBLICATIONS

Van de Sande et al., "Compounds for Use in a Dye Diffusion Transfer Process . . . " *Research Disclosure,* No. 24025, 4/1985.

*Primary Examiner*—Richard L. Schilling
*Attorney, Agent, or Firm*—Sughrue, Mion, Zinn, Macpeak and Seas

[57] ABSTRACT

A silver halide photographic light-sensitive material is described, comprising a support having provided thereon at least one light-sensitive silver halide emulsion layer associated with a substantially immobile, positive one-equivalent redox compound capable of releasing a photographically useful compound or a precursor thereof as a result of a redox reaction, said compound being represented by formula (I)

(I)

wherein Acp represents an anion center precursor capable of causing —Z—Q to be released by a quinonemethide type releasing reaction when being reduced $R^1$ and $R^2$ each represents a hydrogen atom, a substituted or unsubstituted aryl group; Z represents a divalent atomic group; Q represents a group capable of becoming a photographically useful compound or a precursor thereof when released, provided that Q does not contain an atom or atomic group which functions as an electrophilic center that induces an intramolecular substitution reaction; Ball represents a ballast group; M represents a substituent; A represents an organic group which connects Acp, M, and Ball; and n and m each represents an integer of 1 or more.

16 Claims, No Drawings

PHOTOGRAPHIC LIGHT-SENSITIVE MATERIAL WITH REDUCIBLE PHOTOGRAPHICALLY USEFUL MOIETY RELEASER

FIELD OF THE INVENTION

This invention relates to a novel photographic light-sensitive material containing a positive redox compound which releases a photographically useful group. More particularly, this invention relates to a color photographic light-sensitive material containing a positive one-equivalent redox compound which releases a photographically useful group upon redox reaction subsequent to development of silver halides.

BACKGROUND OF THE INVENTION

In a photographic color diffusion transfer process, it is well known to use a redox compound which releases a diffusible dye as a dye image-forming component (dye material). Such a redox compound includes a negative type and a positive type. A negative dye material needs a positive emulsion or other reversal mechanisms for obtaining a positive transfer image. On the other hand, a positive dye material can be used with a negative emulsion for obtaining a positive image, with advantages that light-sensitive materials having high sensitivity can be produced and an interlayer effect can be obtained, and that generation of reversal negative image which is a problem often encountered in a direct positive emulsion upon high illumination exposure can be prevented.

Positive dye materials include immobile carquine compounds as disclosed, for example, in Japanese Patent Application OPI Nos. 130927/79, 164342/81, and 119345/82 (the term "OPI" means published unexamined application). The immobile carquine compounds are preferably used in combination with electron-donor precursors (hereinafter also referred to as ED compounds). In other words, the quinone moiety that is a nucleus of the carquine compounds is reduced by the ED compounds to produce hydroquinone compounds, from which one photographically useful group (e.g., dye) is released per nucleus through a quinonemethide type release reaction.

These carquine compounds are regarded as 2-equivalent because they are reduced by two electrons donated from the ED compounds per quinone nucleus thereof to produce hydroquinones in unexposed areas, and the quinonemethide type release reaction results in release of one photographically useful group. On the other hand, developed silver in exposed areas is cross-oxidized with a developing agent to produce an oxidation product of the developing agent. This oxidation product of the developing agent is then cross-oxidized with the ED compound, thereby inactivating the ED compound. Since such a reaction mechanism preferentially takes place in exposed areas, no photographically useful group is released from the carquine compounds.

Thus, in order to obtain light-sensitive materials having increased sensitivity, nuclei having activities high enough to form images of good contrast with a small amount of silver halide emulsions are required.

SUMMARY OF THE INVENTION

As a result of extensive investigations, the present inventors have now found a one equivalent compound having very high activity with release two photographically useful groups per one nucleus thereof.

Accordingly, an object of the invention is to provide a silver halide phtographic light-sensitive material containing a positive one-equivalent redox compound which release two photographically useful groups per nucleus thereof.

Another object of this invention is to provide a photograhic light-sensitive material for a color diffusion transfer process, which contains the above-described positive redox compound.

A further object of this invention is to provide a heat developable color photographic light-sensitive material which contains the above-described positive redox compound.

These objects of this invention are effectively accomplished by a photographic light-sensitive material comprising a support having provided thereon at least one silver halide emulsion layer associated with a substantially immobile, positive one-equivalent redox compound capable of releasing a photographically useful compound or a precursor thereof as a result of a redox reaction, said compound being represented by formula (I)

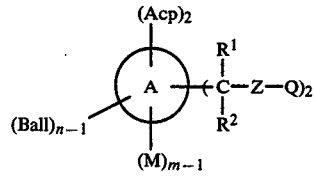

(I)

wherein Acp represents a group, hereinafter referred to as an anion center precursor, capable of causing —Z—Q to be released by quinonemethide type release reaction (different from intramolecular nucleophilic substitution reaction) when being reduced, i.e., an anion center precursor; $R^1$ and $R^2$ each represents a hydrogen atom, a substituted or unsubstituted alkyl group or a substituted or unsubstituted aryl group; Z represents a divalent atomic group; Q represents a group capable of becoming a photographically useful compound or its precursor when released, providing that Q does not contain an atom or atomic group functioning as an electrophilic center that induces an intramolecular substitution reaction; Ball represents a ballast group; M represents a substituent; Ⓐ represents an organic group which connects Acp,

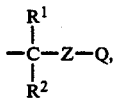

M and Ball; and n and m each represents an integer of 1 or more.

According to the present invention, in the case when the photographically useful groups are dyes, the compounds represented by the above-described formula (I) are stable against oxidation during storage before use of light-sensitive materials, and transfer images of high quality, i.e., images having a low minimum density ($D_{min}$) and a high maximum density ($D_{max}$), can be obtained in a short period of time. Further, because the compounds of the present invention are one-equivalent, they can produce light-sensitive materials having significantly increased sensitivity using a small amount of silver halide emulsion.

DETAILED DESCRIPTION OF THE INVENTION

The term "associated with" used herein for the redox compound of the formula (I) means that the silver halide emulsion layer and a layer containing the redox compound can be positioned in a relationship where the redox reaction occurs when the silver halide is developed with heat or a developing solution. More specifically, the redox compound can be present in any layer so long as it satisfies the above relationship. For example, the redox compound may be present in a silver halide emulsion layer or in a layer adjacent to the silver halide emulsion layer, or any photographic interlayer(s) may be present between the silver halide emulsion layer and the layer containing the redox compound.

The groups of the above-described formula (I) is described below in more detail.

The anion center precursor as represented by Acp means a precursor which becomes an anion center when reduced by an electron-donor precursor (ED compound) which preferably differs from a developing agent used in the system. The anion center thus formed is an inducer to a a quinonemethide type release reaction, which can be formally considered as a reverse Micheal reaction. Specific examples of the anion center precursor include a nitroso group and a nitro group that are precursors for a hydroxyamino group; an oxo group that is a precursor for a hydroxy group; an imino group and an alkylimino group that are precursors for an amino group; a sulfonimido group that is a precursor for a sulfonamido group; and the like. Two Acp groups may be the same or different from each other, and their position may be either in an ortho- or para-position, but is preferably in a para-position. A preferred example of Acp is an oxo group that is a precursor for a hydroxy group.

The organic group as represented by Ⓐ includes a group derived from aromatic hydrocarbon rings (e.g., a benzene ring) or heterocyclic rings and other organic groups having a conjugated double bond (e.g., a group derived from hydrocarbons having a conjugated double bond, such as ethylene, butadiene, etc.), with a group derived from a benzene ring being preferred.

$R^1$ and $R^2$ each represents a hydrogen atom, a substituted or unsubstituted, straight or branched chain or cyclic alkyl group having from 1 to about 40 carbon atoms, or a substituted or unsubstituted aryl group having from 6 to about 30 carbon atoms. The substituent for the alkyl group is not particularly limited and can specifically includes an alkoxy group, a cyano group, a hydroxy group, a halogen atom, a phenoxy group, a substituted phenoxy group, a phenyl group, a substituted phenyl group, etc. Specific examples of the alkyl group include a methyl group, an ethyl group, an n-propyl group, an isopropyl group, an n-butyl group, a t-butyl group, a cyclohexyl group, a dodecyl group, a benzyl group, a chloromethyl group, a hydroxymethyl group, etc. Specific examples of the aryl group include a phenyl group, an alkylphenyl group, an alkoxyphenyl group, a carboxyphenyl group, an alkoxycarbonylphenyl group, an alkylsulfonamidophenyl group, a nitrophenyl group, a cyanophenyl group, a halogenophenyl group, etc.

Preferred examples of the divalent group as represented by Z are

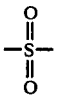

and —O—.

Q represents a group capable of becoming a photographically useful compound when released together with the group Z. Specific examples of the photographically useful compounds include diffusible dyes (i.e., transfer image-forming compounds), anti-fogging, developing agents, hardeners, solvents for silver halides, development inhibitors, development accelerators, fixing agents and the like. These compounds are preferably diffusible in an alkaline state. Specific examples of these compounds are described in *Research Disclosure,* No. 17643 (1978).

The dyes released from dye materials used in the present invention may be complete dyes or may be dye precursors capable of being converted to dyes during photographic development-processing or subsequent processings. The final image dyes may or may not be in the form of a metal complex. Representative dye structures which are useful in the present invention include those dyes that are metal-complexed or not metal-complexed, such as azo dyes, azomethine dyes, anthraquinone dyes and phthalocyanine dyes. Of these, cyan, magenta and yellow dyes are particularly important.

Specific examples of yellow dyes are given in U.S. Pat. Nos. 3,597,200, 3,309,199, 4,013,633, 4,245,028, 4,156,609, 4,139,383, 4,195,992, 4,148,641, 4,148,643 and 4,336,322, Japanese Patent Application OPI Nos. 114930/76 and 71072/81 and *Research Disclosure* Nos. 17630 (1978) and 16475 (1977).

Specific examples of magenta dyes are given in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292 and Japanese Patent Application OPI Nos. 106727/77, 23628/78, 36804/80, 73057/81, 71060/81, and 134/80.

Specific examples of cyan dyes are described in U.S. Pat. Nos. 3,482,972, 3,929,760, 4,013,635, 4,268,625, 4,171,220, 4,242,435, 4,142,891, 4,195,994, 4,147,544 and 4,148,462, British Pat. No. 1,551,138, Japanese Patent Application OPI Nos. 99431/79, 8827/77, 47823/78, 143323/78, 99431/79 and 71061/81, European Pat. (EPC) Nos. 53,037 and 53,040 and *Research Disclosure* Nos. 17630 (1978) and 16475 (1977).

Compounds having a dye moiety in which light absorption is temporarily shifted in a light-sensitive element can also be used as one of precursor moieties of dyes. Specific examples of such compounds are given in U.S. Pat. Nos. 4,310,612, T-999003, 3,336,287, 3,579,334 and 3,982,946, British Pat. No. 1,467,317 and Japanese Patent Application OPI No. 158638/82, etc.

Ball represents a ballast group. Ballast groups are well known in the art and are not restricted in the present invention as long as it has a size sufficient to immobilize the positive redox compounds. The ballast group specifically includes an alkyl group, a substituted alkyl group, an aryl group, and a substituted aryl group, each having from 1 to 40 carbon atoms, and preferably from 6 to 20 carbon atoms.

The substituent as represented by M includes a substituted or unsubstituted alkyl group, a substituted or unsubstituted aryl group (wherein the substituents can be the same as those enumerated for the aforesaid $R^1$ and $R^2$), a halogen atom, a substituted or unsubstituted alkoxy group, a substituted or unsubstituted acyl group, a substituted or unsubstituted acylamino group, a substituted or unsubstituted sulfamoyl group, a substituted or unsubstituted carbamoyl group (wherein the substituents are similar to those enumerated for $R^1$ and $R^2$), etc. M and Ball may be connected to each other to form a condensed ring, e.g., a 5- or 6-membered ring, such as a benzene ring, a pyridine ring and other carbon rings, when Ⓐ is an aromatic hydrocarbon ring or a heterocyclic ring and M and Ball are adjacent to each other on the ring Ⓐ.

The two

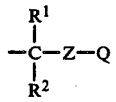

groups are preferably adjacent to each other, i.e., in an ortho-position.

Conventionally known positive redox compounds include BEND compounds as described in U.S. Pat. No. 4,139,379. These known compounds release photographically useful groups (e.g., dyes) in accordance with the following reaction scheme:

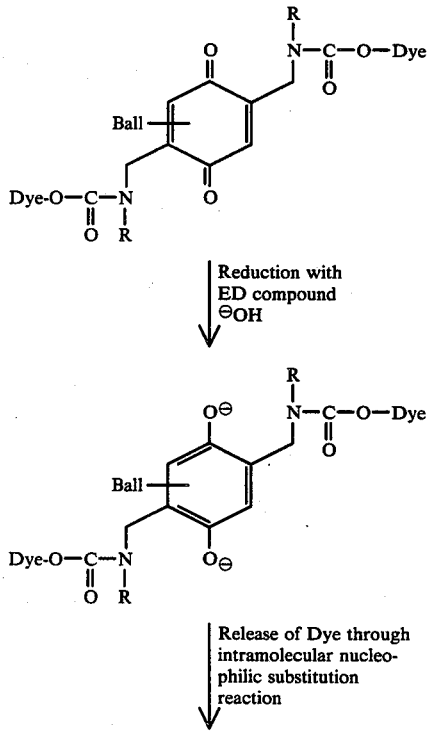

-continued

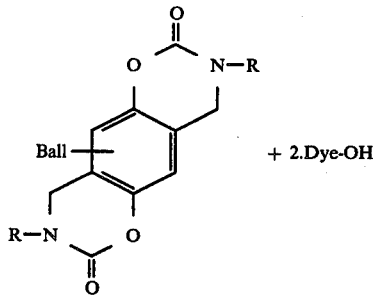

To the contrary, the positive one-equivalent redox compounds according to the present invention release photographically useful groups (e.g., dyes) through the following reaction scheme, in which a compound prepared by introducing dye moieties to the 2- and 3-positions of 1,4-benzoquinone is provided as an example:

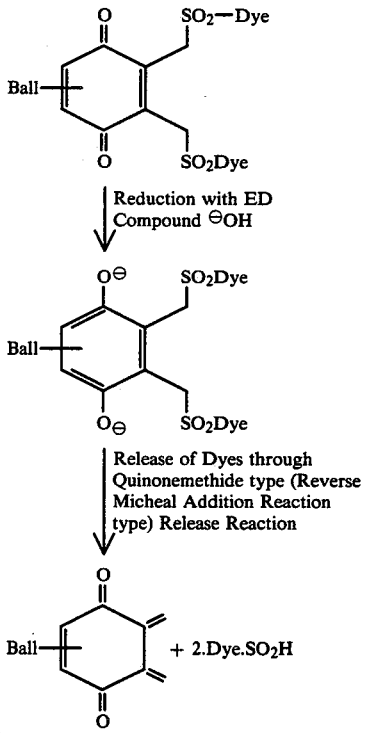

In other words, whereas the BEND compounds are characterized in that after the reduction of the quinone nucleus, the dye moieties are released by an intramolecular nucleophilic substitution reaction, the positive one-equivalent redox compounds according to the present invention are characterized in that after the reduction of the quinone nucleus, two dye moieties are released through a releasing reaction of a reverse Micheal addition type reaction. Therefore, the redox compounds of the present invention behave quite differently from known compounds.

Specific examples of redox compounds represented by formula (I) according to the present invention are illustrated below:

Compound 1
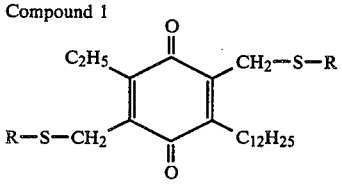
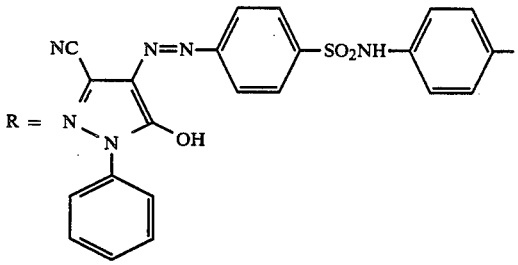
Compound 2
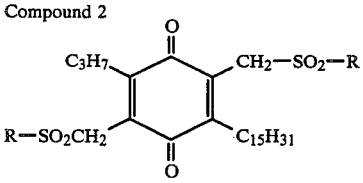
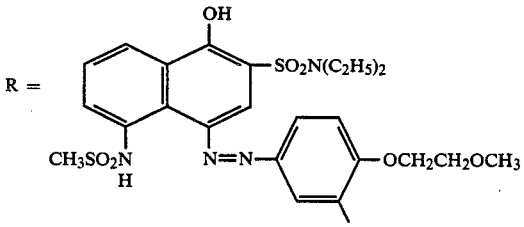
Compound 3
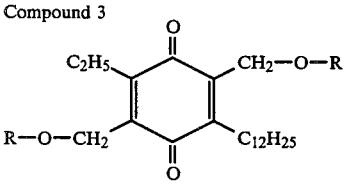
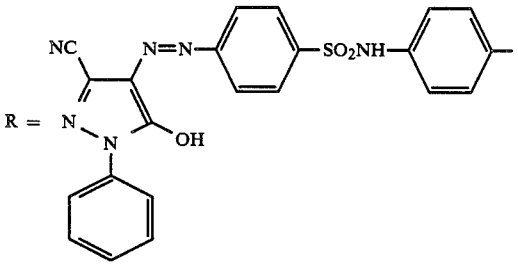
Compound 4
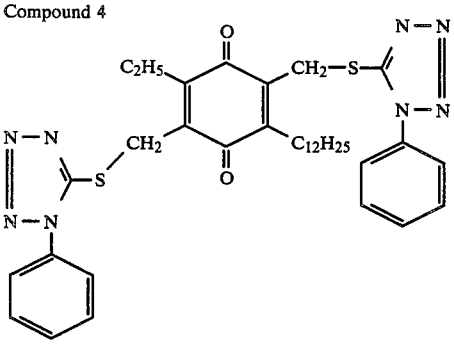
Compound 5
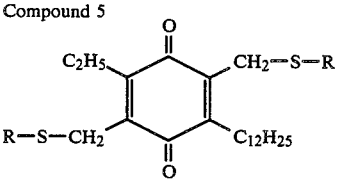
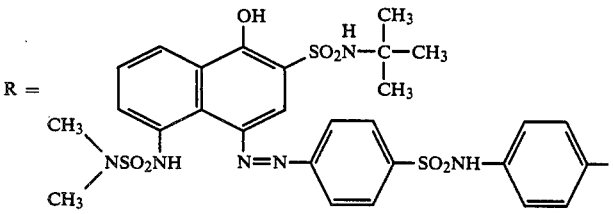

Compound 6
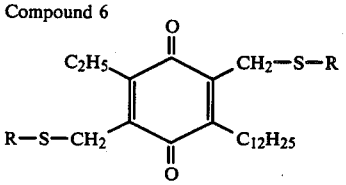
-continued
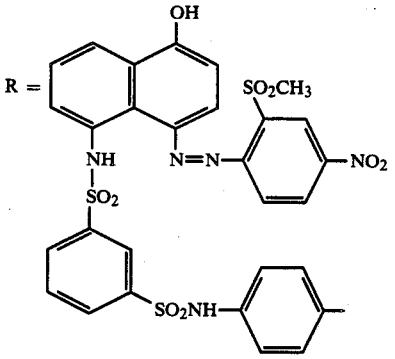
Compound 7
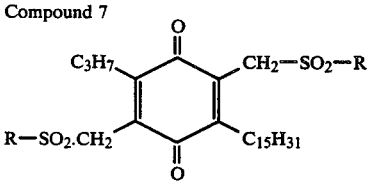
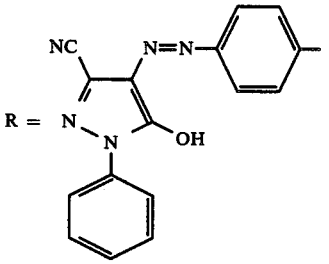
Compound 8
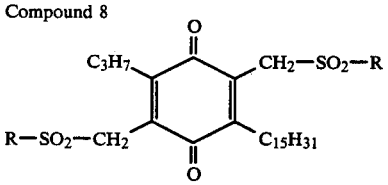
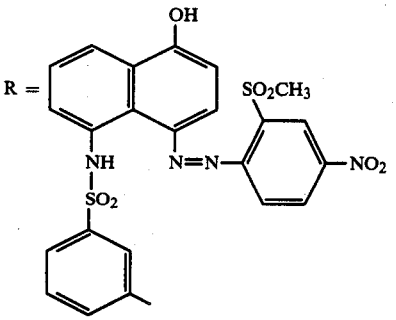
Compound 9
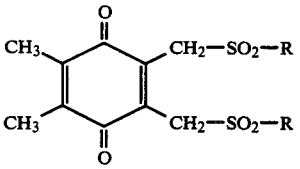
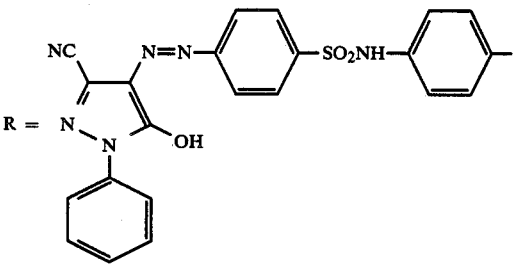
Compound 10
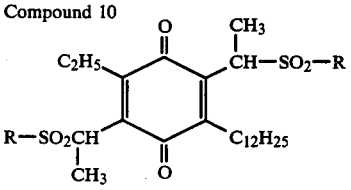
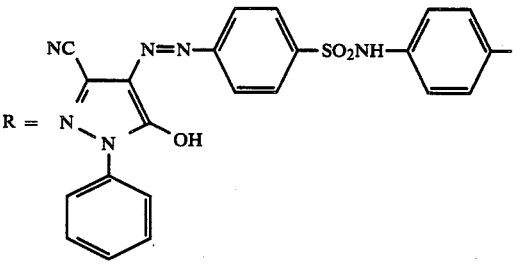
Compound 11

-continued
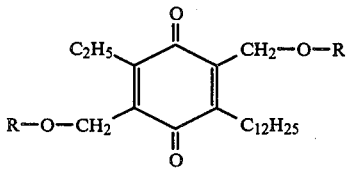
R =
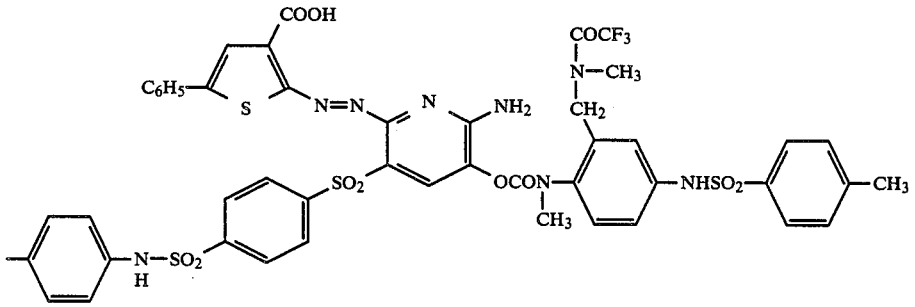
Compound 12
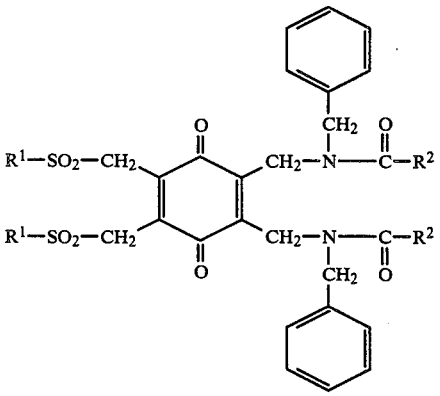
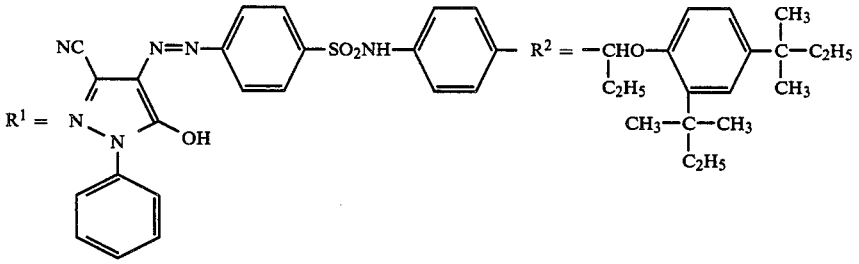
Compound 13
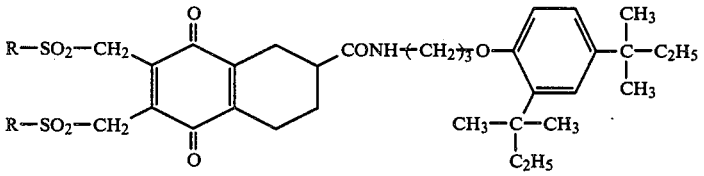

-continued

R =

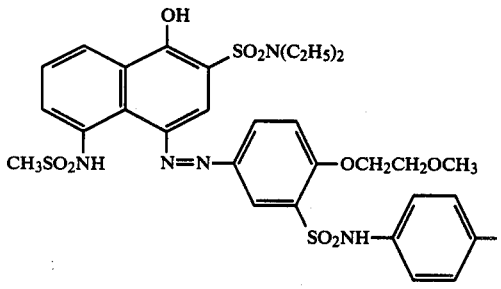

Compound 14

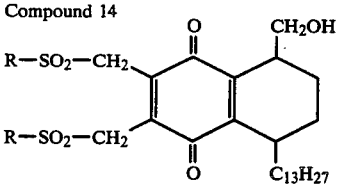

R =

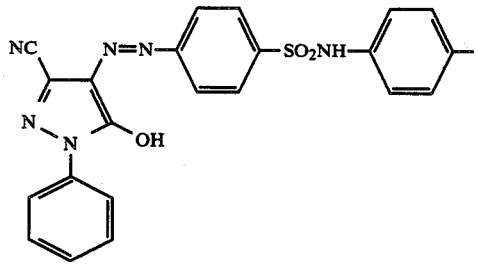

Compound 15

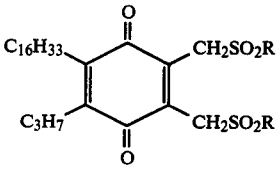

R =

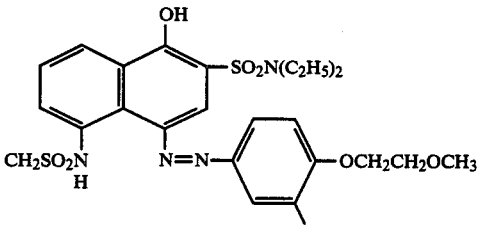

A process for synthesizing the compounds (I) of the present invention will be specifically described with reference to Synthesis Examples.

SYNTHESIS EXAMPLE 1

Reaction Route

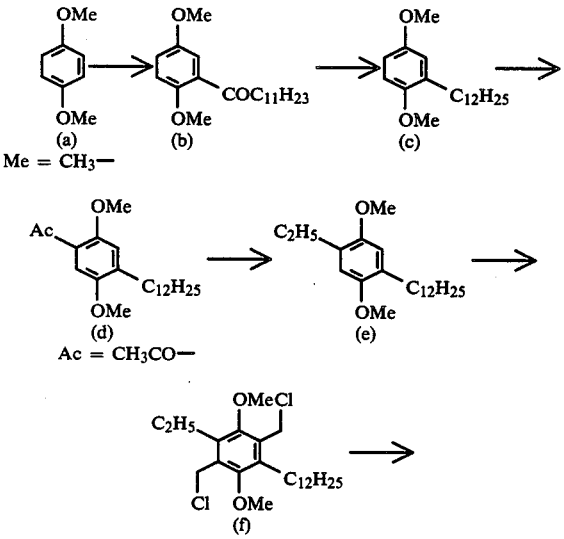

-continued

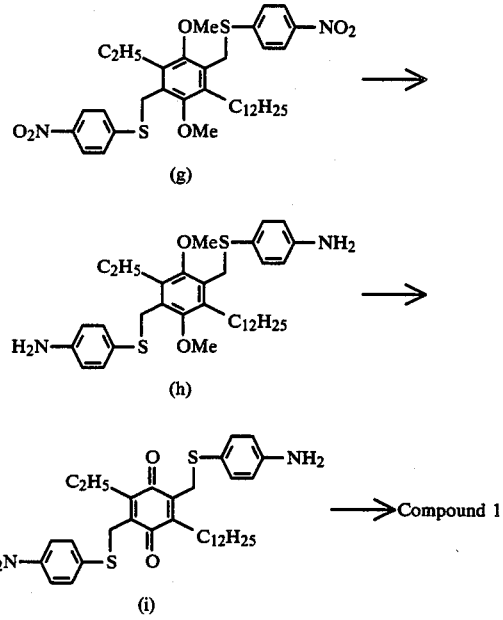

(1) Synthesis of Compound (b)

In 1.5 l of dichloromethane was dissolved 317 g of dimethoxybenzene followed by ice-cooling. Subsequently, 307 g of aluminum chloride was slowly added to the solution, and with stirring 503 g of dodecanoyl chloride was added thereto dropwise over a period of 30 minutes. After the addition, the stirring was continued for an additional one hour under ice-cooling. The resulting mixture was poured into 1 liter of ice-water, and the mixture was extracted with 2 liters of ethyl acetate. The extract was washed twice with a saturated sodium chloride aqueous solution, dried over sodium sulfate and concentrated to obtain 703 g (95%) of Compound (b).

(2) Synthesis of Compound (c)

In a 1 liter-volume autoclave were charged 133 g of Compound (b), 250 ml of acetic acid, 250 ml of t-butanol and 5 g of palladium-on-carbon, and the mixture was allowed to react at 50° C. for 7 hours at a hydrogen pressure of 70 atm. The palladium-on-carbon was removed by filtration, and the filtrate was concentrated to obtain 126 g (99%) of Compound (c).

(3) Synthesis of Compound (d)

In 500 ml of 1,1,2,2-tetrachloroethane was dissolved 270 g of Compound (c), followed by cooling with ice and edible salt. Successively, 118 g of aluminum chloride was slowly added thereto. While stirring, 73 g of acetyl chloride was added thereto slowly so as to maintain the reaction mixture at −5° to 5° C. The stirring was further continued at 0° to 10° C. for 3 hours. The reaction mixture was poured into 1 liter of ice-water and subjected to steam distillation to distill off 1,1,2,2-tetrachloroethane. The resulting aqueous solution was cooled, and the precipitated crystals were separated by filtration and recrystallized from methanol to obtain 269 g (87%) of Compound (d).

(4) Synthesis of Compound (e)

In a 2 liter-volume autoclave were charged 268 g of Compound (d), 500 ml of acetate, 500 ml of t-butanol and 20 g of palladium-on-carbon, and the mixture was stirred at 50° C. for 4 hours at a steam pressure of 62 atm. The palladium catalyst was separated by filtration, and the reaction solution was concentrated. Crystallization from methanol gave 209 g (81%) of Compound (e).

(5) Synthesis of Compound (f)

To 600 ml of dioxane were added 100 g of Compound (e), 225 g of p-formaldehyde and 407 g of anhydrous zinc chloride. Hydrogen chloride gas was blown into the mixture while heating on a steam bath and stirring. After allowing the mixture to cool, the mixture was poured into 2 liters of ethyl acetate and 2 liters of ice-water for extraction. The extract was purified by column chromatography to obtain 57.9 g (45%) of Compound (f).

(6) Synthesis of Compound (g)

In a mixed solvent of 100 ml of dichloromethane and 100 ml of dimethylacetamide was dissolved 7.9 g of p-nitrothiophenol, and 10 g of Compound (f) was added to the solution with stirring. Subsequently, the stirring was continued at room temperature for 2 hours. The reaction mixture was poured into 300 ml of ethyl acetate and 300 ml of ice-water for extraction. The extract was washed twice with a saturated sodium chloride aqueous solution and then purified by column chromatography. Crystallization from methanol yielded 11.6 g (75%) of Compound (g).

(7) Synthesis of Compound (h)

In 120 ml of isopropyl alcohol was dissolved 10 g of Compound (g), and the solution was heat-refluxed. To the solution were successively added 10 g of reduced iron, 2 ml of water and 1 g of ammonium chloride, followed by heat-refluxing for 3 hours. The reaction mixture was filtered using Celite and purified by column chromatography to obtain 3.9 g (43%) of Compound (h).

(8) Synthesis of Compound (i)

In 50 ml of dichloromethane was dissolved 3.9 g of Compound (h), followed by ice-cooling. To the resulting solution was added 6 ml of boron trifluoride while stirring, and the stirring was continued for 3 hours under ice-cooling. A saturated aqueous solution of sodium chloride was added to the reaction mixture for extraction. The extract was again washed with a saturated aqueous solution of sodium chloride. The resulting dichloromethane solution was dried over sodium sulfate, and 4 g of manganese dioxide was added thereto. The mixture was stirred at room temperature for 2 hours and then neutralized with a potassium carbonate aqueous solution. Purification by column chromatography yielded 17 g (46%) of Compound (i).

(9) Synthesis of Compound 1

In 30 ml of dichloromethane was dissolved 1.7 g of Compound (i), and 0.71 ml of pyridine was added thereto, followed by stirring. To the solution was added 2.5 g of the corresponding dye, i.e., sulfonyl chloride [3-cyano-1-phenyl-4-(4-chlorosulfonylphenylazo)-pyrazolone], followed by stirring at room temperature for 1 hour. The reaction mixture was poured into dilute hydrochloric acid and extracted with ethyl acetate. After concentration, the concentrate was purified by column chromatography and crystallized from ethanol to obtain 1.8 g (48%) of Compound 1 having a melting point of 228° C. (with decomposition).

SYNTHESIS EXAMPLE 2

Reaction Route:

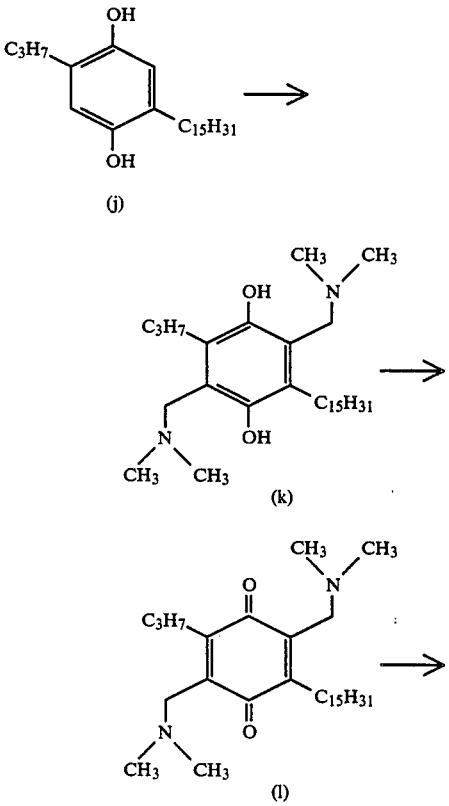

-continued

SYNTHESIS EXAMPLE 2

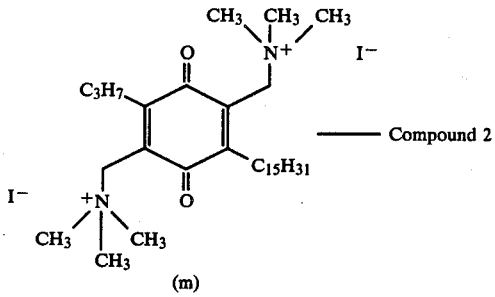

(m)

(1) Synthesis of Compound (k)

To 800 ml of ethanol were added 200 g of Compound (j), 600 ml of a 50% aqueous solution of dimethylamine and 200 g of p-formaldehyde. After stirring, the mixture was heat-refluxed for 5 hours, then allowed to cool. The precipitated crystals were filtered and washed with methanol to obtain 210 g (80%) of Compound (k).

(2) Synthesis of Compould (l)

To 700 ml of ethanol was added 100 g of Compound (k), followed by heat-refluxing. A solution of 230 g of ferric chloride hexahydrate in 800 ml of water and 100 ml of concentrated hydrochloric acid was added thereto dropwise, and the mixture was heat-refluxed for 5 hours. After allowing the mixture to cool, the reaction mixture was extracted with chloroform, and the chloroform layer was washed with a potassium carbonate aqueous solution. The chloroform solution was then concentrated under reduced pressure, and the concentrate was crystallized from acetonitrile to obtain 8.5 g (85%) of Compound (l).

(3) Synthesis of Compound (m)

Fifty milliliters of methyl iodide was added to 9 g of Compound (l), and the mixture was heat-refluxed for 3 hours. The excess of methyl iodide was removed under reduced pressure to obtain 13.6 g (94%) of Compound (m).

(4) Synthesis of Compound 2

To a mixture of 30 ml of dichloromethane and 60 ml of dimethylformamide, 4 g of Compound (m), 2.2 g of sodium acetate and 10.9 g of sulfinic acid [2-diethylsulfamoyl-4-(3-sulfino-4-methoxyethoxyphenylazo)-5-methylsulfonylamino-1-naphthol] were added, and the resulting mixture was stirred at room temperature for 2 hours. Ethyl acetate and a sodium chloride aqueous solution were added thereto for extraction. The extract was concentrated, purified by column chromatography, and crystallized from dichloromethane-hexane to obtain 1.0 g (12%) of Compound 2 having a melting point of 212° C. (with decomposition).

SYNTHESIS EXAMPLE 3

Reaction Route:

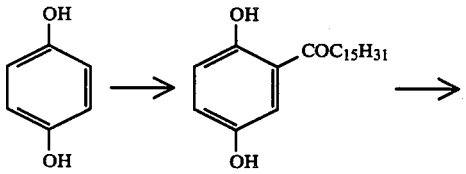

(n) (o)

-continued

SYNTHESIS EXAMPLE 3

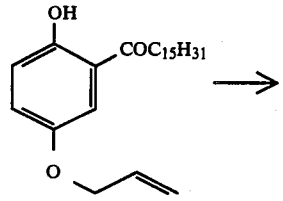

(p)

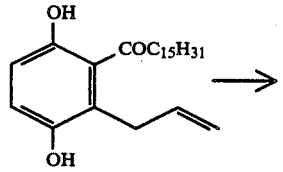

(q)

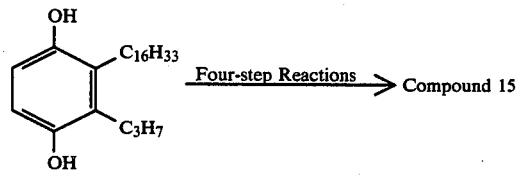

(r)

(1) Synthesis of Compound (o)

110 g of hydroquinone (n) and 256 g of palmitic acid were added to a flask and heated at an external temperature of 80° to 90° C. 97 g of $BF_3$ gas was then blown into the mixture while stirring over a period of 2 hours. Then, the external temperature was adjusted to 140° C. and the mixture was stirred for additional 1.5 hour. After allowing the mixture to cool to 100° C., 2 liters of water containing 150 g of sodium carbonate was added to the reaction mixture. The precipitated crystals were separated by filtration and recrystallized from methanol to obtain 283 g (81%) of Compound (o).

(2) Synthesis of Compound (p)

50 g of Compound (o), 40 ml of allyl bromide and 90 g of potassium carbonate were added to 450 ml of dimethylformamide, and the mixture was heated at 40° C. for 2 hours. The reaction mixture was poured into 1.5 liter of 1N hydrochloric acid, and the mixture was extracted with 1.5 liter of ethyl acetate. The ethyl acetate layer was washed with a saturated aqueous sodium chloride solution, dried over magnesium sulfate and concentrated under reduced pressure. The resulting residue was recrystallized from methanol to obtain 56 g (33%) of Compound (p).

(3) Synthesis of Compound (q)

60 g of Compound (p) was placed in a flask in an oil bath and the external temperature was gradually elevated to 230° C. while passing nitrogen gas with stirring. After 30 minutes, the oil bath was removed, and the mixture was allowed to cool. 100 ml of hexane was then added to the mixture to obtain 45 g (75%) of Compound (q).

(4) Synthesis of Compound (r)

45 g of Compound (q), 4.5 g of 5% palladium-carbon, 500 ml of acetic acid and 500 ml of t-butyl alcohol were charged in a 2 liter-autoclave. The mixture was then stirred vigorously under a hydrogen pressure of 50 atms. at a reaction temperature of 50° C. for 5 hours. After allowing to cool, the reaction mixture was filtered through Celite, concentrated under reduced pressure and recrystallized from ligroin to obtain 32 g (73%) of Compound (r).

(5) Synthesis of Compound 15

In the same manner as described in Synthesis of Compound 2 above, Compound (r) was subjected to the four-step reactions, i.e., Mannich reaction, oxidation, quaternarization reaction and nucleophilic substitution reaction of sodium sulfide, to obtain Compound 15.

According to the present invention, when dyes are employed as photographically useful groups, the compounds represented by formula (I) can be used as positive dye materials in color photography, and transfer dye images can be obtained by the reaction mechanism illustrated below. In the following, the description refers to the case of a so-called negative silver halide emulsion, in which latent images are predominantly formed on the surfaces of silver halide grains. That is, the present invention will now be explained with respect to the case of using the compounds of the present invention as positive color materials in a color diffusion transfer process.

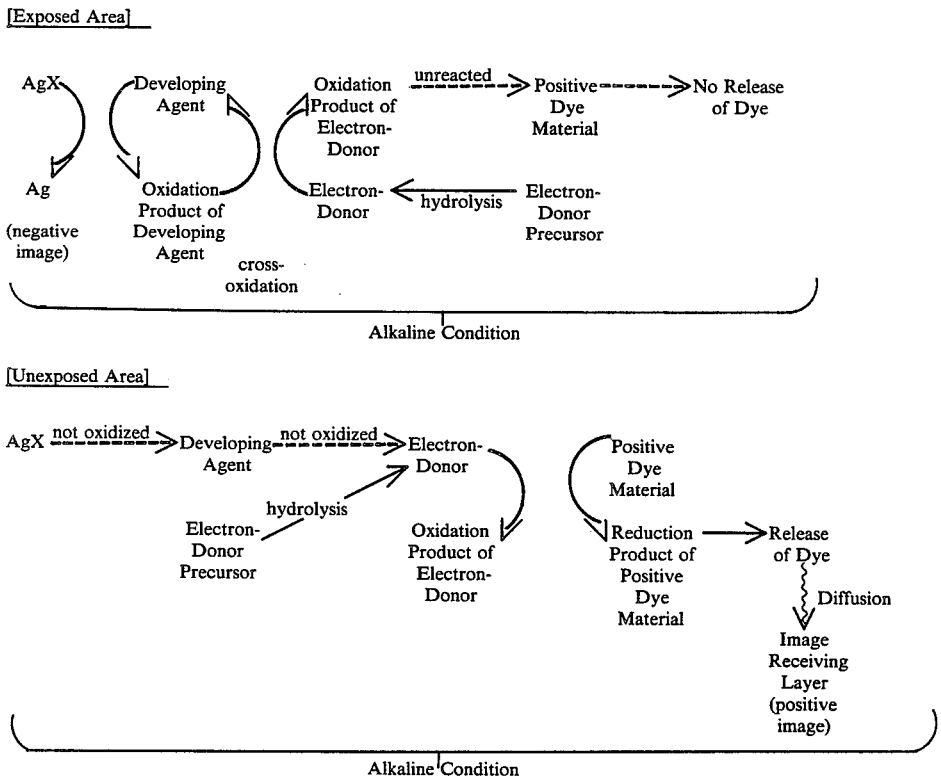

The above-described positive dye materials are positive and immobile compounds which can release dyes upon reduction under an alkaline condition (i.e., upon transfer thereto of at least one electron), and are preferably used in combination with electron-donor precursors (ED compounds).

The electron-donor precursors which can be used in the present invention preferably include compounds represented by formulae (ED-1), (ED-II) and (ED-III).

Formula (ED-I) is represented as

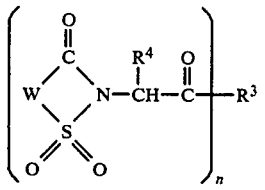

(ED-I)

wherein W represents an atomic group forming a mono-, di-, or tricyclic ring, each ring being preferably 5- or 6-membered. Condensed rings which constitute the di- or tricyclic ring include aromatic rings, e.g., a benzene ring, a naphthalene ring, etc. n represents 1 or 2. When n is 1, $R^3$ represents a substituted or unsubstituted monovalent aromatic ring, e.g., a benzene ring. When n is 2, $R^3$ represents a divalent aromatic ring. $R^4$ represents a substituent such as a hydrogen atom, an alkyl group, a substituted alkyl group, an aryl group, a substituted aryl group, an acyl group, an ester group, and an amido group.

Formula (ED-II) is represented as

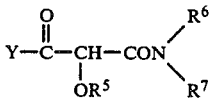

(ED-II)

wherein $R^5$ represents an alkali-labile group, such as an acetyl group, an acyl group (e.g., a benzoyl group) and an N-substituted carbamoyl group; Y represents an alkyl group having from 1 to about 30 carbon atoms, a substituted alkyl group, an aryl group or a substituted aryl group; and $R^6$ and $R^7$, which may be the same or different, each represents a hydrogen atom, an alkyl group having from 1 to about 30 carbon atoms, a substituted alkyl group, an aryl group having from 6 to about 30 carbon atoms or a substituted aryl group.

Formula (ED-III) is represented as (ED-III)

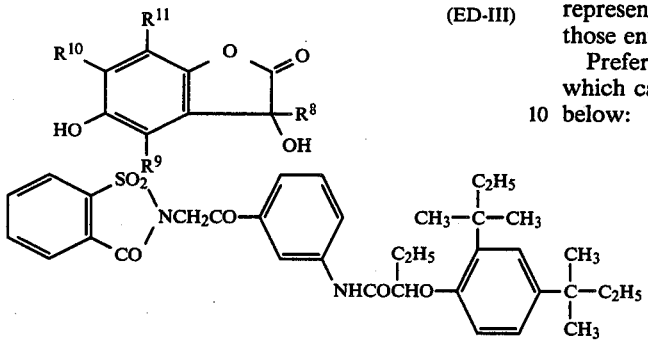

wherein $R^8$ represents a substituted or unsubstituted aromatic or heterocyclic group; and $R^9$, $R^{10}$ and $R^{11}$, which may be the same or different, each represents a hydrogen atom, a substituted or unsubstituted alkyl group having from 1 to about 30 carbon atoms or an alkyloxy or alkylthio group having from 1 to about 30 carbon atoms.

In the above-described formulae (ED-I) to (ED-III), substituents for the substituted alkyl or aryl groups as represented by $R^4$, Y, $R^6$, $R^7$ and $R^9$ to $R^{11}$ are similar to those enumerated for $R^1$ and $R^2$ in the formula (I).

Preferred examples of the electron-donor precursors which can be used in the present invention are shown below:

ED-1

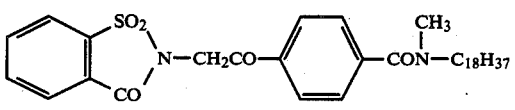

ED-2

ED-3

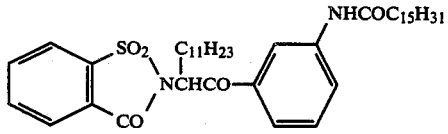

ED-4

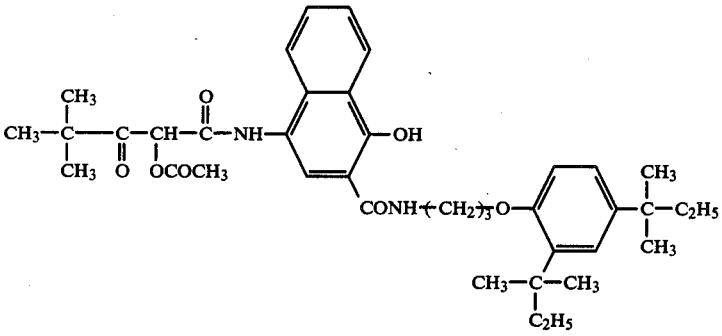

ED-5

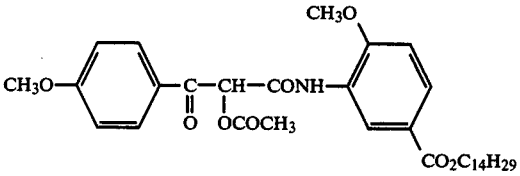

ED-6

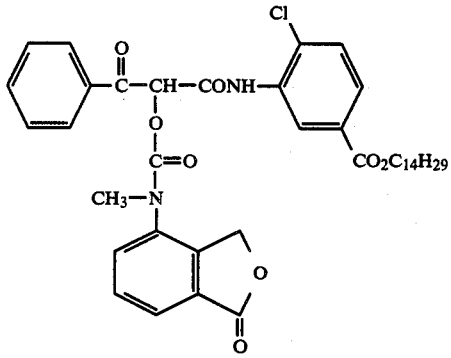

ED-7

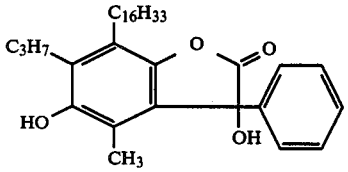

ED-8

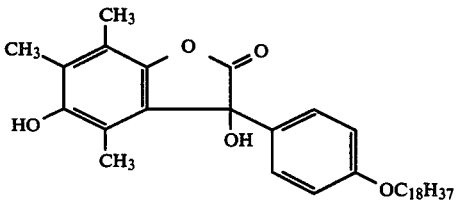

As described above, developing agents present in light-sensitive materials act as electron-transfer or cross-oxidizing agents in exposed areas during development of silver halides and effectively play a role to inhibit the function of electron-donors.

Such developing agents specifically include hydroquinone compounds, e.g., hydroquinone, 2,5-dichlorohydroquinone and 2-chlorohydroquinone; aminophenol compounds, e.g., 4-aminophenol, N-methylaminophenol, 3-methyl-4-aminophenol and 3,5-dibromoaminophenol; catechol compounds, e.g., catechol, 4-cyclohexylcatechol, 3-methoxycatechol and 4-(N-octadecylamino)catechol; phenylenediamine compounds, e.g., N,N-diethyl-p-phenylenediamine, 3-methyl-N,N-diethyl-p-phenylenediamine, 3-methoxy-N-ethyl-N-ethoxy-p-phenylenediamine, 3-methoxy-N-ethyl-N-ethoxy-p-phenylenediamine and N,N,N'-tetramethyl-p-phenylenediamine; 3-pyrazolidone compounds, e.g., 1-phenyl-3-pyrazolidone, 1-phenyl-4,4-dimethyl-3-pyrazolidone, 4-hydroxymethyl-4-methyl-1-phenyl-3-pyrazolidone, 1-(4-tolyl)-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-4-methyl-4-hydroxymethyl-3-pyrazolidone, 1-(3-tolyl)-3-pyrazolidone, 1-(3-tolyl)-4,4-dimethyl-3-pyrazolidone, 1-(2,2,2-trifluoromethyl)-4,4-dimethyl-3-pyrazolidone and 5-methyl-3-pyrazolidone; and the like. Among them, 3-pyrazolidone compounds are preferred.

These developing agents can be used in combinations of two or more thereof, as described in U.S. Pat. No. 3,039,869. The developing agents may be incorporated into a developing solution, or at least a part thereof may be incorporated into an appropriate layer of light-sensitive materials (or film units), such as silver halide emulsion layers, dye material-containing layers, intermediate layers, image-receiving layers, etc.

Silver halides used in photographic emulsions of the present invention may be any of silver bromide, silver iodobromide, silver iodochlorobromide, silver chlorobromide, and silver chloride. Preferred silver halides include silver bromide, silver iodobromide and silver iodochlorobromide containing not more than 20 mol% of iodides and not more than 30 mol% of chlorides. A particularly preferred silver halide is silver iodobromide containing from 2 to 15 mol% of iodine.

Individual silver halide grains may comprise a core and an outer shell having different phases or may be homogeneous. Further, they may be those in which a latent image is formed predominantly on their surfaces or those in which a latent image is predominantly formed in the interior thereof.

The electron-donor precursor and the positive redox compound of this invention are generally dispersed in hydrophilic colloids by the following methods. That is, both the electron-donor precursor and the compound of the present invention are dissolved in an organic solvent, and the solution is added to a solution of a hydrophilic colloid and dispersed therein as fine droplets. When the solvent is a volatile substance, such as ethyl acetate, tetrahydrofuran, methyl ethyl ketone, etc., it can be removed during a drying step of photographic layers or by the method described in U.S. Pat. Nos. 2,322,027 and 2,801,171. When the solvent is a water-soluble substance, such as dimethylformamide, 2-methoxyethanol, etc., it can be removed by the method disclosed in U.S. Pat. Nos. 2,949,360 and 3,396,027. However, in order to stabilize dispersions of the electron-donor precursor and the compound of the present invention, and to accelerate formation of dye images, it is advantageous to incorporate the immobile compound of this invention into a solvent which is substantially water-insoluble and has a boiling point of 200° C. or higher at atmospheric pressure. Such a solvent includes, for example, dibutyl phthalate, tricresyl phosphate, trihexyl phosphate, tricyclohexyl phosphate, N,N-diethyllauramide, etc. Further, in order to accelerate dissolution of dye materials, it is desirable to auxiliarily use the above-mentioned volatile or water-soluble solvents.

Furthermore, oleophilic polymers can also be employed instead of, or in addition to, the above-described high boiling solvents.

Use of surface active agents as emulsifying aids greatly favors dispersion of the electron-donor precursor and the compound of the present invention. Useful surface active agents for this purpose are described in Japanese Patent Publication No. 4923/64 and U.S. Pat. No. 3,676,141.

The hydrophilic colloids which can be used for dispersing the electron-donor precursor and the compound of this invention include gelatin, colloidal albumin, casein, cellulose derivatives, e.g., carboxymethyl cellulose, hydroxyethyl cellulose, etc., sugar derivatives, e.g., agar, sodium alginate, starch derivatives, etc., synthetic hydrophilic colloids, e.g., polyvinyl alcohol, poly N-vinyl-pyrrolidone, polyacrylic acid copolymers, polyacrylamide and derivatives thereof (e.g., partial hydrolysates). If necessary, a mixture comprising two or more of these colloids which are compatible with each other may be used. Of these hydrophilic colloids, gelatin is most generally used, but a part or the whole of the gelatin may be displaced with the synthetic hydrophilic colloids.

The coverage of the compounds of the present invention when used as dye material ranges from $1\times10^{-4}$ to $1\times10^{-2}$ mol/m$^2$, and preferably from $2\times10^{-4}$ to $2\times10^{-3}$ mol/m$^2$. This range of coverage can be increased or decreased according to the particular purposes of use. The coverage of the electron-donor precursor ranges from $0.5\times10^{-4}$ to $5\times10^{-2}$ mol/m$^2$, preferably from $1\times10^{-4}$ to $1\times10^{-2}$ mol/m$^2$.

A developing solution to be used for development-processing of the photographic light-sensitive materials of the present invention contains bases, such as sodium hydroxide, potassium hydroxide, sodium carbonate, sodium phosphate, etc., and preferably has a pH value of about 9 or more, particularly 11.5 or more. The developing solution can contain an antioxidant, e.g., sodium sulfite, ascorbates, piperidinohexose reductone, etc., and a silver ion concentration controlling agent, e.g., potassium bromide. Further, the developing solution can contain a thickener, e.g., hydroxyethyl cellulose, sodium carboxymethyl cellulose, etc.

Furthermore, the alkaline developing solution can contain a compound which accelerates development or diffusion of dyes, such as benzyl alcohol.

For reproduction of natural colors according to subtractive color photography, a light-sensitive material comprising at least a combination of a silver halide emulsion having selective spectral sensitivity in a certain wavelength region and a dye material having selective spectral absorption in such a wavelength region or a dye material capable of forming such a dye is employed. In particular, a light-sensitive material comprising a combination of a blue-sensitive silver halide emulsion and a positive yellow dye material, a combination of a green-sensitive emulsion and a magenta dye material, and a combination of a red-sensitive emulsion and a cyan dye material is useful. These unit combinations of emulsions and dye materials may be coated in layers in the light-sensitive material in such a manner that each layer containing the unit combination faces to each other. Otherwise, the unit combination may be formulated into grains in each of which the positive dye material and the silver halide grains are present, and different grains are mixed and coated in one layer.

Color mixing can be prevented by using a scavenger for an oxidized developing agent in various intermediate layers constituting the photographic light-sensitive material of the present invention. Such a scavenger includes the di-striaght chain alkylhydroquinones described in U.S. Pat. Nos. 2,728,659 and 2,732,300 and Japanese Patent Publication No. 15745/69; the di-branched chain alkylhydroquinones described in U.S. Pat. No. 2,732,300, Japanese Patent Publication Nos. 15745/69 and 106329/74 and Japanese Patent Application OPI Nos. 4819/77 and 29637/79; the mono-straight chain alkylhydroquinones described in U.S. Pat. No. 2,7278,659 and Japanese Patent Publication No. 10632/74; the mono-branched chain alkylhydroquinones described in Japanese Patent Publication No. 15745/79 and Japanese Patent Application OPI Nos. 106329/74 and 156438/75; the hydroquinones described in Japanese Patent Application OPI Nos. 109344/81, 17949/82 and 43521/80; and the scavengers for developing agent oxidation products described in *Research Disclosure* Nos. 18143, 18144 and 18169, Japanese Patent Application OPI Nos. 118831/79, 24941/82 and 125738/81.

A parting layer may be provided between an intermediate layer and a layer containing a positive dye material as described in Japanese Patent Application OPI No. 52056/80. Further, an intermediate layer may contain a silver halide emulsion as described in Japanese Patent Application No. 67850/81.

In the case of applying the light-sensitive materials of the present invention to color diffusion transfer process, a mordant layer, a neutralization layer, a neutralization rate controlling layer (timing layer), and so on which can be suitably used are conventional layers as described in, for example, Japanese Patent Application OPI No. 64533/77.

Polymer mordants which can be used in the present invention include polymers containing secondary and tertiary amino groups, polymers having a nitrogen-containing heterocyclic moiety and polymers containing quarternary cation groups, the molecular weights of these polymers generally being more than 5,000, and preferably more than 10,000. Examples of these polymers include vinylpyridine polymers and vinylpyridinium cation polymers as disclosed in U.S. Pat. Nos. 2,548,564, 2,484,430, 3,148,061 and 3,756,814; vinyl-imidazolium cation polymers as disclosed in U.S. Pat. No. 4,124,386; polymer mordants crosslinkable with gelatin, etc., as disclosed in U.S. Pat. Nos. 3,625,694, 3,859,096 and 4,128,538 and British Pat. No. 1,277,453; aqueous sol type mordants disclosed in U.S. Pat. Nos. 3,958,995, 2,721,852 and 2,798,063, Japanese Patent Application OPI Nos. 115228/79, 145529/79, 126027/79, 155835/79 and 17352/81; water-insoluble mordants as disclosed in U.S. Pat. No. 3,898,088; reactive mordants capable of covalently bonding to dyes, as disclosed in U.S. Pat. Nos. 4,168,976 and 4,201,840; and mordants as disclosed in U.S. Pat. Nos. 3,709,690, 3,788,855, 3,642,482, 3,488,706, 3,557,066, 3,271,147 and 3,271,148, Japanese Patent Application OPI Nos. 30328/78, 155528/77, 125/78, 1024/78 and 107835/78 and British Pat. No. 2,064,802. In addition, the mordants described in U.S. Pat. Nos. 2,675,316 and 2,882,156 can also be used.

An image-receiving layer which mordants azo dyes having a chelating group is preferably a mordant layer or its adjacent layer in which a polymer capable of immobilizing transition metal ions and transition metal ions are incorporated. Examples of such a polymer capable of immobilizing transition metal ions are given in Japanese Patent Application OPI Nos. 48210/80 and 129346/80 and U.S. Pat. Nos. 4,273,853, 4,282,305, 4,193,796, 4,288,511 and 4,241,163.

When the light-sensitive materials according to the present invention are applied to a color diffusion transfer process, the light-sensitive materials can have any of various film structures including a peel-apart type film unit, an integrated type film unit (peeling is unnecessary) as described in Japanese Patent Publication Nos. 16356/81 and 33697/73, Japanese Patent Application OPI No. 13040/75 and British Pat. No. 1,330,524, the layer structure as disclosed in Japanese Patent Application OPI No. 119345/82, and an integrated film unit having provided thereon a parting layer. In any of the above-described structures, it is advantageous in view of broadening the range of allowable development temperatures to use a polymer acid layer protected with a temporary blocking layer comprising a fused latex polymer as disclosed, for example, in Japanese Patent Application (OPI) Nos. 145217/77, 72622/78, 78130/79, 138432/79 and 138433/79 or a lactone ring-containing polymer as disclosed in Japanese Patent Application OPI No. 54341/80 and *Research Disclosure* No. 18425 (1979), by which the time for controlling neutralization rates (timing) can be shortened.

The light-sensitive materials according to the present invention can also be applied to heat development photographic system. The elements and developing methods employable in the heat development system are described in Japanese Patent Application OPI No. 58543/83.

In order to determine the rate of releasing photographically useful groups from the compounds of the present invention, experiments were conducted in a solution system in accordance with the following procedures.

METHOD OF DETERMINATION 4.5 ml of a tetrahydrofuran solution containing $4.86\times10^{-6}$ mol each of Compound 4 and ED Compound 1 was prepared and kept at 25° C. To the solution was added, all at once, 3 ml of a 0.1N aqueous solution of sodium hydroxide kept at 25° C. with stirring thereby initiating the reaction.

After the lapse of a certain time, a 1N aqueous solution of acetic acid was added thereto to adjust the pH to 6, thereby stopping the reaction. An eluent comprising tetrahydrofuran, water, triethylamine and acetic acid in a volume ratio of 650/350/1/1 was added to the reaction mixture to make 10 ml. The 1-phenyl-5-mercaptotetrazole in the resulting solution was quantitatively determined by high performance liquid chromatography using LS-410 (produced by Toyo Soda Manufacturing Co., Ltd.) as a filler. The rate of release of 1-phenyl-5-mercaptotetrazole was obtained from a previously prepared calibration curve.

The foregoing determination method is for the reaction at a molar ratio of Compound 4 to ED Compound 1 of 1:1. In the same manner as described above, the rate of release in the reaction at a molar ratio of 1:5 was determined. The results obtained are tabulated below.

| Compound 4/ED Compound 1 Molar Ratio | 50% Release Time ($t_{\frac{1}{2}}$) of 1-Phenyl-5-Mercaptotetrazole (sec) |
|---|---|
| 1/1 | 16 |
| 1/5 | 3 |

The fact that the 50% release time ($t_{\frac{1}{2}}$) for 1-phenyl-5-mercaptotetrazole (i.e., photographically useful compound) was 16 seconds at a molar ratio (Compound 4/ED Compound 1) of 1/1 indicates that two photographically useful groups had been released from one nucleus of the positive redox compound of the present invention [which corresponds to A in the formula (I)] with comparatively high efficiency, i.e., the compound of the present invention is a satisfactory one-equivalent type redox compound. Further, the fact that $t_{\frac{1}{2}}$ was 3 seconds at a molar ratio of 1/5 indicates that the compound of the present invention releases photographically useful groups at an extremely high rate.

The present invention will now be illustrated in greater detail with reference to example, but it should be understood that these examples are not construed to limit the present invention. In the examples, all percents are given by weight unless otherwise indicated.

EXAMPLE 1

An integrated type light-sensitive sheet for color diffusion transfer process, a cover sheet and a developing solution were prepared in accordance with the following methods.

Preparation of Light-Sensitive Sheet

Onto a polyethylene terephthalate transparent support having a subbing layer thereon, the following layers (1) to (6) were coated in this order to prepare Light-Sensitive Sheets 1 to 3.

(1) An image-receiving layer containing 3.0 g/m$^2$ of copoly[styrene-N-vinylbenzyl-N-methylpiperidinium chloride] and 3.0 g/m$^2$ of gelatin.

(2) A white light reflecting layer containing 20 g/m$^2$ of titanium dioxide and 2.0 g/m$^2$ of gelatin.

(3) A light-screening layer containing 2.0 g/m$^2$ of carbon black and 0.5 g/m$^2$ of gelatin.

(4) A layer containing the dye material of Table 1 in the indicated amount, the ED compound of Table 1 in an amount equimolar with the dye material, 0.1 g/m$^2$ of N,N-diethyllaurylamide and 1.0 g/m$^2$ of gelatin.

(5) A layer containing a silver iodobromide emulsion comprising 0.8 g/m$^2$ of silver and 0.8 g/m$^2$ of gelatin (iodide content: 5 mol%).

(6) A protecting layer containing 0.5 g/m$^2$ of gelatin and 0.02 g/m$^2$ of triacryloyltriazine as a hardener.

Preparation of Cover Sheet

The following layers (1') to (3') were coated in the order listed onto a transparent polyethylene terephthalate support to prepare a cover sheet.

(1') A layer containing 22 g/m$^2$ of a 8/20 (by weight) copolymer of acrylic acid and butyl acrylate and 0.44 g/m$^2$ of 1,4-bis(2,3-epoxypropoxy)-butane.

(2') A layer containing 3.8 g/m$^2$ of acetyl cellulose having such an acetyl value that hydrolysis of a 100 g sample gives 39.4 g of an acetyl group), 0.23 g/m$^2$ of a methanol ring-opened product of a 60:40 (by weight) copolymer of styrene and maleic anhydride (molecular weight=ca. 50,000) and 0.154 g/m$^2$ of 5-(2-cyano-1-methylethylthio)-1-phenyltetrazole.

(3') A 2micron-thick layer formed by coating a mixture consisting of a 49.7/42.3/3/5 (by weight) copolymer latex of styrene/n-butyl acrylate/acrylic acid/N-methylol acrylamide and a 93/4/3 (by weight) copolymer latex of methyl acrylate/acrylic acid/N-methyl acrylamide at a mixing proportion of 6/4 (solid basis).

Developing Solution 1-p-Tolyl-4-hydroxymethyl-4-methyl-3-pyrazolidone: 10 g
Methyl hydroquinone: 0.3 g
5-Methylbenzotriazole: 3.5 g
Anhydrous sodium sulfite: 0.2 g
Sodium carboxymethyl cellulose: 58 g
Potassium hydroxide (28% aqueous solution): 300 ml
Benzyl alcohol: 1.5 ml
Carbon black: 150 g
Water to make: 1 liter Each of the thus prepared Light-Sensitive Sheets 1 to 3 was exposed through a wedge of continuous gradation. The exposed light-sensitive sheet was development-processed in the above-described developing solution together with the cover sheet with an aid of a pair of rollers. After 1 hour, the density was measured by means of a color densitometer. The maximum density ($D_{max}$) and the minimum density ($D_{min}$) obtained are shown in Table 1.

As can be seen from Table 1, the light-sensitive sheets wherein the dye materials of the present invention were used provide color images having high $D_{max}$ and low $D_{min}$, which indicate excellent image discrimination.

TABLE 1

| Light-Sensitive Sheet | Dye Material: Compound No. | Dye Material: Color | Dye Material: Coverage | Coverage of ED Compound | $D_{max}$ | $D_{min}$ |
|---|---|---|---|---|---|---|
| 1 | 2 | Magenta | $3.0 \times 10^{-4}$ | $3.0 \times 10^{-4}$ | 1.55 | 0.19 |
| 2 | 7 | Yellow | $5.0 \times 10^{-4}$ | $5.0 \times 10^{-4}$ | 1.33 | 0.20 |
| 3 | 8 | Cyan | $3.0 \times 10^{-4}$ | $3.0 \times 10^{-4}$ | 1.90 | 0.28 |

EXAMPLE 2

A peeling-apart type light-sensitive sheet for color diffusion transfer process, an image-receiving sheet and a developing solution were prepared according to the following method.

Light-Sensitive Sheet 4

Onto a polyethylene terephthalate transparent support having a subbing layer thereon, the following layers were coated in the order listed below.

(1) A layer containing $3\times10^{-4}$ mol/m$^2$ of Compound 2, $3\times10^{-4}$ mol/m$^2$ of ED-4, 0.1 g/m$^2$ of N,N-diethyllaurylamide and 1.0 g/m$^2$ of gelatin.

(2) A layer containing a silver iodobromide emulsion (iodide content: 5 mol%) comprising 0.8 g/m$^2$ of silver and 0.8 g/m$^2$ of gelatin.

(3) A protecting layer containing 1.0 g/m$^2$ of gelatin and 0.02 g/m$^2$ of triacryloyltriazine as a hardener.

Image-Receiving Sheet

Paper Support: A paper base having a thickness of 150 μm laminated with polyethylene on both sides thereof to a thickness of 30 μm each. The polyethylene on the image-receiving layer side contained titanium oxide in an amount of 10% based on the weight of the polyethylene.

Back Side: The following layers (a), (b) and (c) were coated in the order listed.

(a) A light-screening layer containing 4.0 g/m$^2$ of carbon black.

(b) A white layer (light-reflecting background layer) containing 8.0 g/m$^2$ of titanium oxide and 1.0 g/m$^2$ of gelatin.

(c) A protecting layer containing 0.6 g/m$^2$ of gelatin.

Image-Receiving Side:

(1) A neutralization layer containing 22 g/m$^2$ of an acrylic acid/butyl acrylate copolymer (8/2 by molar ratio) having a mean molecular weight of 50,000.

(2) A neutralization timing layer containing 4.5 g/m$^2$ of a mixture consisting of cellulose acetate having an acetyl value of 51.3% (hydrolysis of 1 g sample releases 0.513 g of acetic acid) and a styrene/maleic anhydride copolymer (1/1 by mole) having a mean molecular weight of about 10,000 at a mixing proportion of 95/5 by weight.

(3) A layer containing 1.6 g/m$^2$ (on a solic basis) of a mixture consisting of a polymer latex obtained by emulsion polymerizing styrene, butyl acrylate, acrylic acid and N-methylolacrylamide at a weight ratio of 49.7:42.3:4:4 and a polymer latex obtained by emulsion polymerizing methyl methacrylate, acrylic acid and N-methylolacrylamide at a weight ratio of 93/3/4 at a mixing proportion of 6/4 on a solid basis.

(4) An image-receiving layer formed by coating 3.0 g/m$^2$ of the polymer

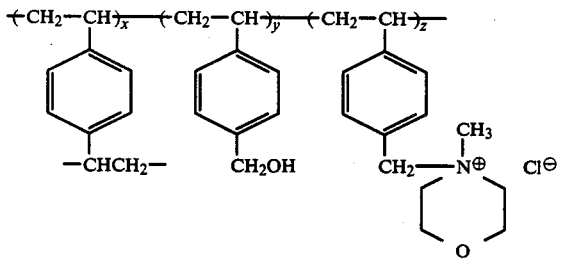

x/y/z = 5/5/90 and 3.0 g/m$^2$ of gelatin, using

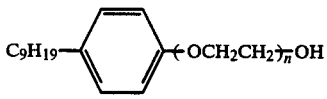

(n = 30)

as a coating aid.

(5) A protecting layer containing 0.6 g/m$^2$ of gelatin.

Developing Solution 1-p-Tolyl-4-hydroxymethyl-4-methyl-3-pyrazolidone: 6.9 g
Methyl hydroquinone: 0.3 g
5-Methylbenzotriazole: 3.5 g
Anhydrous sodium sulfite: 0.2 g
Sodium carboxymethyl cellulose: 58 g
Potassium hydroxide (28% aqueous solution): 300 ml
Benzyl alcohol: 1.5 ml
Water: 735 ml The above-prepared light-sensitive sheet was exposed through a color test chart, and the above-described image-receiving sheet was superposed thereon. Both sheets were passed through the above-described developing solution so as to spread the developing solution therebetween to a thickness of 85 microns with the aid of pressure rollers.

The development was carried out at 25° C., and 120 seconds after the development, the light-sensitive sheet and the image-receiving sheet were peeled apart from each other.

On the image-receiving sheet was formed a sharp reversal image with its $D_{max}$ and $D_{min}$ being 2.1 and 0.09, respectively.

Then, undeveloped Light-Sensitive Sheet 4 was dipped in a fixing solution (Hypo 30%) for 10 minutes, washed with running water and dried. The thus treated light-sensitive sheet was then developed in the same manner as described above. The image-receiving sheet was peeled off at 5-second intervals for 1 minute, then at 15-second intervals for the next 2 minutes later, and then 5 minutes later and 30 minutes later. The dye material remaining on the resulting light-sensitive sheet was extracted with a mixed solvent of 85% N,N-dimethylformamide and 15% water and quantitatively determined by means of a spectrophotometer. The thus obtained amounts of the remaining dye material were plotted against time to prepare a decay curve. From this decay curve, it could be read that the remaining dye material after 30 minutes was 0.9% and the half-life period (time for 50% dacay) was 35 seconds.

The amount of the remaining dye material as low as 0.9% proves that the compound of the present invention is one-equivalent redox compound which effectively releases two dyes per nucleus, and the half-life as short as 35 seconds shows that the rate of release is very high. Accordingly, it can be seen that the compound of the present invention is a superior dye material.

EXAMPLE 3

Onto a polyethylene terephthalate transparent support having a subbing layer, the following layers (1) to (6) were coated in this order to prepare Light-Sensitive Sheets 5 to 7.

(1) to (3): The same layers as Layers (1) to (3) of Example 1.

(4) A layer containing $3\times10^{-4}$ mol/m$^2$ of a magenta dye material (Compound 2), $3\times10^{-4}$ mol/m$^2$ of ED-4, 0.1 g/m$^2$ of N,N-diethyllaurylamide and 0.8 g/m$^2$ of gelatin.

(5) A layer containing a silver bromide emulsion (silver content: 0.6 g/m$^2$), 0.5 mol%/mol-Ag of the compound indicated in Table 1 (i.e., development inhibitorreleasing compound), 0.05 g/m$^2$ of N,N-diethyllaurylamide and 0.6 g/m$^2$ of gelatin.

(6) The same layer as Layer (6) of Example 1.

In the same manner as in Example 1, each of the above light-sensitive sheets was exposed and developed using the same cover sheet and developing solution as used in Example 1. Densities of the resulting image were measured, and the results of reading $D_{max}$, $D_{min}$, gamma, and sensitivity are shown in Table 2.

As is apparent from Table 2, it can be seen that the light-sensitive sheets in which the development inhibitor-releasing compounds of the present invention were used exhibit increased $D_{max}$ without adverse influences such as reduction of sensitivity and contrast.

In the case of Light-Sensitive Sheet 7 in which the conventional development inhibitor was used, not only silver fog but also desired image development was retarded, resulting in great reduction of contrast. On the other hand, it is believed that the development inhibitor-releasing compounds according to the present invention release development inhibitors in the reverse of silver images so that the released inhibitors selectively inhibit only the silver fog without retarding the desired development, thereby causing no reduction in contrast.

TABLE 2

| Light-Sensitive Sheet | Development Inhibitor Compound No. | Development Inhibitor Coverage (mol/m²) | ED Compound Compound No. | ED Compound Coverage (mol/m²) | $D_{max}$ | $D_{min}$ | Gamma* | Relative** Sensitivity | Remark |
|---|---|---|---|---|---|---|---|---|---|
| 5 | 4 | $2.8 \times 10^{-5}$ | ED-4 | $2.8 \times 10^{-5}$ | 2.05 | 0.27 | 1.9 | 0 | Invention |
| 6 | A*** | $2.8 \times 10^{-5}$ | — | — | 2.05 | 0.28 | 0.5 | −2.3 | Comparison |
| 7 | B*** | $2.8 \times 10^{-5}$ | — | — | 1.98 | 0.27 | 0.8 | −1.2 | " |
| 8 | — | — | — | — | 1.25 | 0.27 | 1.05 | 0 | " |

Note:
*The slope between two points of $D_{max} - 0.2$ and $D_{min} + 0.2$.
**S0.5: The sensitivity at the point of D = 0.5 Δlog E (relative value)
***Compound A:

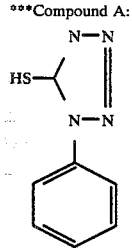

Compound B:

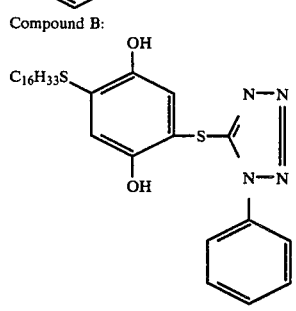

While the invention has been described in detail and with reference to specific embodiments thereof, it will be apparent to those skilled in the art that various changes and modifications can be made therein without departing from the spirit and scope thereof.

What is claimed is:

1. A silver halide photographic light-sensitive material comprising a support having provided thereon at least one light-sensitive silver halide emulsion layer associated with a substantially immobile, positive one-equivalent redox compound capable of releasing a photographically useful compound or a precursor thereof as a result of a redox reaction, said compound being represented by formula (I):

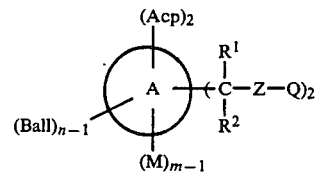

(I)

wherein Acp are located in the para position and represents an anion center precursor which is an oxo group and is capable of causing —Z—Q to be released by a quinonemethide type releasing reaction when being reduced; $R^1$ and $R^2$ each represents a hydrogen atom, a substituted or unsubstituted alkyl group or a substituted or unsubstituted aryl group; Z represents —S—, —O— and —$SO_2$—; Q represents a group capable of becoming a photographically useful compound or a precursor thereof when released, provided that Q does not contain an atom or atomic group which functions as an electrophilic center that induces an intramolecular substitution reaction; Ball represents a ballast group; M represents a substituent; represents an organic group which connects Acp,

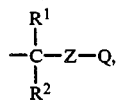

M, and Ball and is an organic group derived from a 1,4 benzohydroquinone compound; and n and m each represents an integer of 1 or more.

2. A silver halide photographic light-sensitive material as in claim 1, wherein the redox compound represented by the formula (I) is used in combination with an electrondonor precursor.

3. A silver halide photographic light-sensitive material as in claim 2, wherein the electron-donor precursor is represented by the formula (ED-I), (ED-II), or (ED-III):

(ED-I)

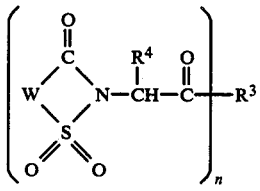

wherein W represents an atomic group forming a mono-, di- or tricyclic ring, n represents 1 or 2, $R^3$ represents a substituted or unsubstituted monovalent aromatic ring when n is 1, or $R^3$ represents a divalent aromatic ring when n is 2, $R^4$ represents a hydrogen atom, an alkyl group, a substituted alkyl group, an aryl group, a substituted aryl group, an acyl group, an ester group, or an amido group;

(ED-II)

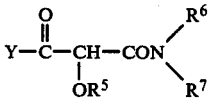

wherein, $R^5$ represents an alkali-labile group; Y represents an alkyl group having from 1 to about 30 carbon atoms, a substituted alkyl group, an aryl group or a substituted aryl group; and $R^6$ and $R^7$, which may be the same or different, each represents a hydrogen atom, an alkyl group having from 1 to about 30 carbon atoms, a substituted alkyl group, an aryl group having from 6 to about 30 carbon atoms or a substituted aryl group;

(ED-III)

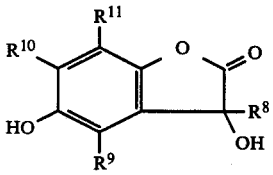

wherein $R^8$ represents a substituted or unsubstituted aromatic or heterocyclic group; and $R^9$, $R^{10}$ and $R^{11}$, which may be the same or different, each represents a hydrogen atom, a substituted or unsubstituted alkyl group having from 1 to about 30 carbon atoms or an alkyloxy or alkylthio group having from 1 to about 30 carbon atoms.

4. A silver halide photographic light-sensitive material as in claim 2, wherein the electron-donor precursor is used in an amount of from $0.5\times10^{-4}$ to $5\times10^{-2}$ mol/m$^2$.

5. A silver halide photographic light-sensitive material as in claim 4, wherein the electron-donor precursor is uded in an amount of from $1\times10^{-4}$ to $10^{-2}$ mol/m$^2$.

6. A silver halide photographic light-sensitive material as in claim 1, wherein $R^1$ and $R^2$ each represents a hydrogen atom, a substituted or unsubstituted straight or branched chain or cyclic alkyl group having from 1 to about 40 carbon atoms, or a substituted or unsubstituted aryl group having from 6 to about 30 carbon atoms.

7. A silver halide photographic light-sensitive material as in claim 1, wherein Z represents

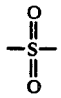

or —O—.

8. A silver halide photographic light-sensitive material as in claim 1, wherein the photographically useful compound is a diffusible dye, an anti-foggant, a developing agent, a hardener, a solvent for silver halide, a development inhibitor, a development accelerator, or a fixing agent.

9. A silver halide photographic light-sensitive material as in claim 1, wherein Ball represents a substituted or unsubstituted alkyl group having from 1 to 40 carbon atoms or a substituted or unsubstituted aryl group.

10. A silver halide photographic light-sensitive material as in claim 1, wherein M represents a substituted or unsubstituted alkyl group, a substituted or unsubstituted aryl group, a halogen atom, a substituted or unsubstituted alkoxy group, a substituted or unsubstituted acyl group, a substituted or unsubstituted acylamino group, a substituted or unsubstituted sulfamoyl group or a substituted or a substituted or unsubstituted carbamoyl group.

11. A silver halide photographic light-sensitive material as in claim 1, wherein M and Ball are connected to each other to form a condensed ring, and M and Ball are adjacent to each other.

12. A silver halide photographic light-sensitive material as in claim 1, wherein the two

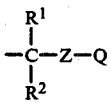

groups are in an ortho-position with respect to each other.

13. A silver halide photographic light-sensitive material as in claim 1, wherein the redox compound represented by the formula (I) is used in an amount of from $1\times10^{-4}$ to $1\times10^{-2}$ mol/m$^2$.

14. A silver halide photographic light-sensitive material as in claim 13, wherein the redox compound is used in an amount of from $2\times10^{-4}$ to $2\times10^{-3}$ mol/m$^2$.

15. A silver halide photographic light-sensitive material comprising a support having provided thereon at least one light-sensitive silver halide emulsion layer associated with a substantially immobile, positive one-equivalent redox compound capable of releasing a photographically useful compound or a precursor thereof as a result of a redox reaction in an amount of from $1\times10^{-4}$ to $1\times10^{-2}$ mol/m$^2$, said compound being represented by formula (I):

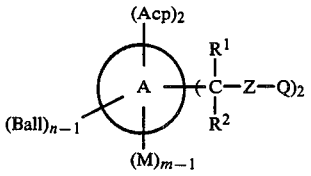

(I)

wherein Acp are located in the para position and represents an oxo group; $R^1$ and $R^2$ each represents a hydrogen atom, a substituted or unsubstituted straight or branched chain or cyclic alkyl group having about 1 to about 40 carbon atoms, or a substituted or unsubstituted aryl group having form 6 to 30 carbon atoms; Z represents

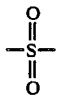

or —O—; Q represents a group capable of becoming a photographically useful compound or a precursor thereof when released wherein the photographically useful compound is a diffusible dye, an antifoggant, a developing agent, a hardener, a solvent for silver halide, a development accelerator, or a fixing agent, provided that Q does not contain an atom or atomic group which functions as an electrophilic center that induces an intramolecular substitution reaction; Ball represents a substituted or unsubstituted alkyl group having from 1 to 40 carbon atoms or a substituted or unsubstituted aryl group; M represents a substituted or unsubstituted alkyl group, a substituted or unsubstituted aryl group, a halogen atom, a substituted or unsubstituted alkoxy group, a substituted or unsubstituted acyl group, a substituted or unsubstituted acylamino group, a substituted or unsubstituted sulfamoyl group or a substituted or unsubstituted carbamoyl group; represents an organic group which connects Acp,

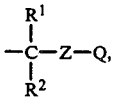

M, and Ball and is an organic group derived from a 1,4 benzohydroquinone compound; and n and m each represents an integer of 1 or more.

16. A silver halide photographic light-sensitive material as in claim 15, wherein the redox compound is used in an amount of from $2\times10^{-4}$ to $2\times10^{-3}$ mol/m$^2$.

* * * * *